US008807226B2

(12) United States Patent
Møgedal

(10) Patent No.: US 8,807,226 B2
(45) Date of Patent: Aug. 19, 2014

(54) SUBSEA WELLHEAD ASSEMBLY

(75) Inventor: Øystein Møgedal, Oslo (NO)

(73) Assignee: Aker Subsea AS, Lysaker (NO)

( * ) Notice: Subject to any disclaimer, the term of this patent is extended or adjusted under 35 U.S.C. 154(b) by 138 days.

(21) Appl. No.: 13/256,507

(22) PCT Filed: Apr. 14, 2010

(86) PCT No.: PCT/NO2010/000136

§ 371 (c)(1),
(2), (4) Date: Sep. 14, 2011

(87) PCT Pub. No.: WO2010/120184

PCT Pub. Date: Oct. 21, 2010

(65) Prior Publication Data

US 2012/0000667 A1 Jan. 5, 2012

(30) Foreign Application Priority Data

Apr. 14, 2009 (NO) ..... 20091448

(51) Int. Cl.
*E21B 33/035* (2006.01)
*E21B 36/00* (2006.01)

(52) U.S. Cl.
CPC ..... *E21B 36/001* (2013.01); *E21B 33/035* (2013.01)
USPC ..... 166/347; 166/350; 166/368; 166/344; 166/335

(58) Field of Classification Search
CPC ..... E21B 36/01; E21B 36/05; E21B 36/00; E21B 36/001
USPC ..... 166/345, 347, 350, 368, 367, 357
IPC ..... E21B 36/01,36/05
See application file for complete search history.

(56) References Cited

U.S. PATENT DOCUMENTS

| | | | | |
|---|---|---|---|---|
| 2,628,852 | A * | 2/1953 | Voytech | 277/408 |
| 3,384,169 | A * | 5/1968 | Leonard | 166/357 |
| 3,556,218 | A * | 1/1971 | Talley et al. | 166/265 |
| RE27,308 | E * | 3/1972 | Leonard | 166/357 |
| 4,126,406 | A | 11/1978 | Traylor et al. | |
| 4,705,114 | A * | 11/1987 | Schroeder et al. | 166/357 |
| 5,649,594 | A * | 7/1997 | Flak et al. | 166/277 |
| 6,032,732 | A | 3/2000 | Yewell | |
| 6,267,172 | B1 | 7/2001 | McClung, III | |
| 6,588,500 | B2 * | 7/2003 | Lewis | 166/61 |
| 7,669,659 | B1 * | 3/2010 | Lugo | 166/345 |
| 7,686,086 | B2 * | 3/2010 | Brammer | 166/357 |
| 7,721,807 | B2 * | 5/2010 | Stoisits et al. | 166/366 |
| 2006/0144622 | A1 | 7/2006 | Bailey et al. | |
| 2006/0175063 | A1 * | 8/2006 | Balkanyi et al. | 166/357 |
| 2007/0131429 | A1 * | 6/2007 | Brammer | 166/357 |
| 2010/0175883 | A1 * | 7/2010 | Benson | 166/335 |

OTHER PUBLICATIONS

Løvås, Bjørn, International Search Report for PCT/NO2010/000136, as mailed Jul. 9, 2010, 3 pages.

* cited by examiner

*Primary Examiner* — James Sayre
(74) *Attorney, Agent, or Firm* — Winstead PC

(57) ABSTRACT

Subsea wellhead assembly with an inner bore for conduction of produced hydrocarbons, equipped with a cooling means for cooling a section of the wellhead assembly exposed to heating by said hydrocarbons.

10 Claims, 1 Drawing Sheet

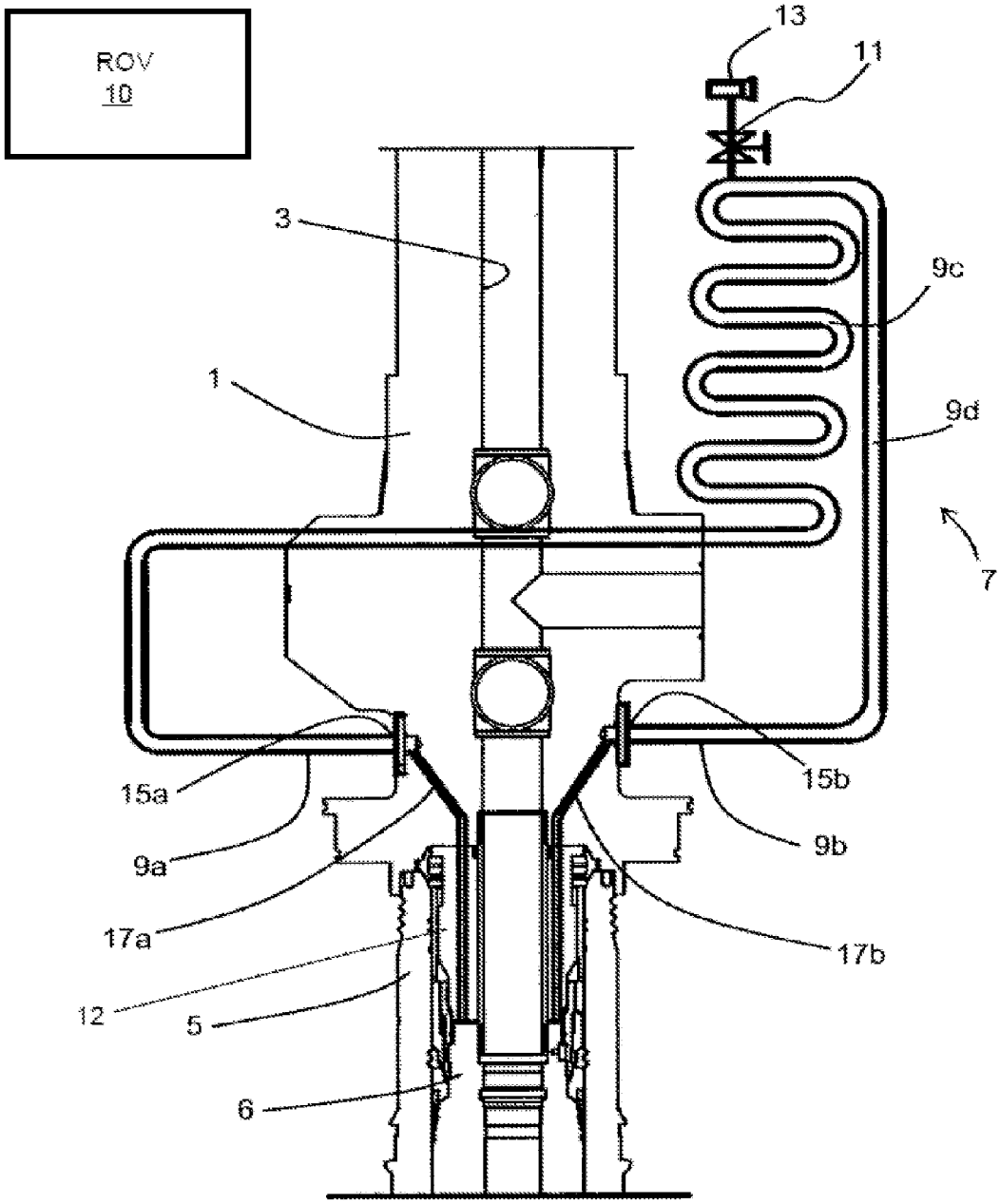
ROV
10
13
11
3
9c
1
9d
7
15a
15b
9a
9b
17a
17b
12
5
6

SUBSEA WELLHEAD ASSEMBLY

The present invention relates to subsea wellhead assemblies arranged to conduct a flow of hydrocarbons from an oil and/or gas well.

BACKGROUND

Modern subsea wellhead assemblies and Xmas trees are becoming more and more advanced. The sea depths at which they are applied are increasing, involving correspondingly larger pressures. In addition, modern drilling technology results in wells that extend deeper into the ground, resulting in high temperatures of the hydrocarbons flowing out of them. The temperature of the hydrocarbons can for instance be in the area of 150-200° C. and even higher in some cases. The wellhead assemblies are also exhibiting more features than before, and comprise equipment such as electric and hydraulic connections and conductors. As an example, such connections and conductors currently used elastomeric material sealing that tolerate temperatures in the range of −18° C. to 150° C., while there is a need for equipment that tolerate temperatures up to for instance 180° C. and above. Equipment for such conditions is difficult to make, and the needed materials are significantly more expensive.

Another type of component exposed to excessive heat is seals constituting pressure barriers. Being exposed to the high pressure differences in combination with possible large variations in temperatures requires excellent material characteristics and appropriate design.

In order to account for the higher demands on the wellhead components with regards to mechanical stability, combined with the elevated temperatures of the hydrocarbons flowing through it, one has thus sought out materials with extreme characteristics. This has met the demands on the components to great extent. However, with the conditions and demands on the equipment continuously increasing, the use of better materials is not sufficient.

Another way to take into account challenges resulting from the high temperatures is to provide a more clever design of the subsea wellhead assembly, such as the design of the Xmas tree. However, there is limited available space outside the hydrocarbon-containing flow in the bore of the Xmas tree, making it difficult to overcome said challenges in this manner.

U.S. Pat. No. 6,267,172 describes a method for exchanging heat between a pipeline through which fluid is flowable and an earth heat exchanger trough which heat transfer fluid flows.

U.S. Pat. No. 4,126,406 describes downhole cooling of the electric pump motor, motor protector, and thrust bearing of a submergible pump assembly in a high temperature environment.

U.S. Pat. No. 6,032,732 describes a system for heating the well head assembly of a conventional oil well pumper.

The present invention seeks to provide equipment for a subsea wellhead assembly, such as a subsea Xmas tree, capable of complying with such extreme requirements as mentioned above. In addition, the invention seeks to reduce the demands on the components of the equipment with regards to mechanical stability combined with high temperatures, thereby omitting the use of expensive components.

SUMMARY

According to the present invention, a subsea wellhead assembly with an inner bore for conduction of produced hydrocarbon, said assembly is characterised in that it is provided with an inlet port and an outlet port at the ends of an inlet channel and outlet channel, respectively, adapted to be connected to a cooling fluid, wherein said channels extend into the assembly to a region suitable for cooling of components exposed to heating from a warm flow of said hydrocarbons.

Said inlet port and outlet port are preferably adapted to be connected to said cooling fluid by an ROV. Thus, there is provided a possibility of installing a cooling loop after the subsea wellhead assembly has been installed. If needed, such a cooling loop can be provided with a pump for flow control. In addition, if extreme cooling requirements are needed, one can also imagine installing a heat pump in order to cool the assembly with fluid significantly colder than the surrounding sea water. The inlet port and the outlet port can also advantageously be used for venting out air and to inject cooling fluid.

Herein, the term subsea wellhead assembly should be construed to involve not only the components of the wellhead itself, but also connected equipment such as a Xmas tree, tubing hanger and wellhead system.

DETAILED DESCRIPTION

Having described the main features of the subsea Xmas tree according to the present invention, a more detailed example of embodiment will now be described with reference to FIG. 1.

FIG. 1 is a cross sectional schematic view of a vertical subsea Xmas tree 1, arranged on the sea floor on top of a subsea well. The Xmas tree 1 has an inner bore 3 for conducting hydrocarbons from the well.

In order to prevent the Xmas tree components in the region within a wellhead 5 and above a tubing hanger 6 from being excessively heated, a cooling means 7 is arranged to the Xmas tree 1. The cooling means 7 comprises a fluid-conducting pipe 9. The pipe 9 has an inlet 9*a* guiding cooled cooling fluid into the Xmas tree 1 and an outlet 9*b* guiding heated cooling fluid out of the Xmas tree 1. The pipe 9 also has a radiator part 9*c* adapted for effective heat convection to the ambient sea water. It should be noted that a substantial part of the pipe 9 has a vertical extension. This results in a siphon effect in the cooling fluid, since the colder cooling fluid has larger density than the warmer cooling fluid. This principle is well known to a man skilled in the art. Thus, by arranging the pipe 9 with such a vertical extension, the need for a pump to provide circulation of cooling fluid is avoided.

Preferably the pipe 9 has a vertical part 9*d* extending in a substantially straight manner beside the radiator part 9*c*.

On an upper side of the pipe 9 there is arranged a valve 11 and an inlet port 13 for accessing the interior of the pipe 9. The pipe channel may also be connected to a flow control valve (not shown) for the possibility of preventing flow in the pipe 9. Such a valve can preferably be ROV 10 operated (remotely operated vehicle).

The pipe 9 interfaces with the Xmas tree 1 at an inlet port 15*a* and an outlet port 15*b*. From these ports 15*a*, 15*b*, an inlet channel 17*a* and an outlet channel 17*b* extend into the region 12 between Xmas tree 1 and the tubing hanger 6, guiding cooling fluid to region 12 containing or being adjacent to components that shall be protected from excessive heating by hot flow of hydrocarbons in the bore 3.

It should be apparent for a person skilled in the art that the above example of embodiment only describes one of a plurality of possible embodiments within the scope of the present invention, as put forth in the claims. Thus, instead of the vertical Xmas tree shown in FIG. 1, the invention will also apply to a horizontal Xmas tree, as well as other heat-exposed parts of a subsea wellhead assembly.

The invention claimed is:

1. A subsea wellhead assembly comprising:

an inner bore, at least part of which extends through a Xmas tree landed on a subsea wellhead, for conduction of produced hydrocarbons;

the subsea wellhead having components exposed to heating from a warm flow of hydrocarbons produced through the inner bore;

a region located in the subsea wellhead adjacent to the inner bore;

wherein the subsea wellhead comprises an inlet port and an outlet port at ends of an inlet channel and an outlet channel, respectively, connected to a cooling fluid, wherein the inlet channel conducts the cooling fluid to the region and the outlet channel conducts the cooling fluid out from the region, wherein the region is suited for cooling the subsea wellhead components; and wherein the inlet channel and the outlet channel are channels other than the inner bore and without the possibility of fluid communication with the inner bore.

2. The subsea wellhead assembly of claim 1, wherein said inlet and outlet ports are adapted to be connected to said cooling fluid by a remotely operated vehicle ("ROV").

3. The subsea wellhead assembly of claim 1, wherein the inlet channel and the outlet channel are sealed off with respect to the inner bore.

4. The subsea wellhead assembly of claim 1, wherein the region is formed between the Xmas tree and a tubing hanger disposed in the subsea.

5. The subsea wellhead assembly of claim 1, wherein the inlet port and the outlet port are located at an interface of the Xmas tree.

6. The subsea wellhead assembly of claim 5, wherein the region is formed between the Xmas tree and a tubing hanger disposed in the subsea wellhead.

7. A subsea wellhead assembly, comprising:

a Xmas tree arranged on a wellhead;

an inner bore for conducting produced hydrocarbons extending through the Xmas tree and a tubing hanger located in the wellhead;

a cooling fluid conducting pipe located exterior of the Xmas tree and extending between an inlet and an outlet, wherein the cooling fluid conducting pipe is not in fluid communication with the inner bore;

the inlet of the cooling fluid conducting pipe interfacing with the Xmas tree at an inlet port of an inlet channel extending through the Xmas tree into the wellhead and in fluid communication with a region between the Xmas tree and the tubing hanger and adjacent to the inner bore; and the outlet of the cooling fluid conducting pipe interfacing with the Xmas tree at an outlet port of an outlet channel extending through the Xmas tree into the wellhead and in fluid communication with the region.

8. The subsea wellhead assembly of claim 7, wherein the cooling fluid conducting pipe comprises a substantially vertical extension and a radiator part.

9. The subsea wellhead assembly of claim 7, wherein a pump is not connected with the cooling fluid conducting pipe.

10. The subsea wellhead assembly of claim 8, wherein the substantially vertical extension is located between the outlet and the radiator part.

* * * * *

UNITED STATES PATENT AND TRADEMARK OFFICE

CERTIFICATE OF CORRECTION

PATENT NO. : 8,807,226 B2
APPLICATION NO. : 13/256507
DATED : August 19, 2014
INVENTOR(S) : Møgedal It is certified that error appears in the above-identified patent and that said Letters Patent is hereby corrected as shown below:

In the Claims

| | |
|---|---|
| Column 3, Claim 4, Line 31 | Delete "disposed in the subsea." and insert -- disposed in the subsea wellhead. -- |

Signed and Sealed this
Twenty-eighth Day of October, 2014

Michelle K. Lee

Michelle K. Lee
*Deputy Director of the United States Patent and Trademark Office*